US007905717B2

(12) United States Patent
Whittome et al.

(10) Patent No.: US 7,905,717 B2
(45) Date of Patent: Mar. 15, 2011

(54) PD PUMPS WITH A COMMON GEARBOX MODULE AND VARYING CAPACITIES AND EASY ACCESS TO MECHANICAL SEALS

(75) Inventors: Robert R. Whittome, Eastbourne (GB); Steven Allen, Bexhill on Sea (GB)

(73) Assignee: Wright Flow Technologies Limited, Eastbourne (GB)

( * ) Notice: Subject to any disclaimer, the term of this patent is extended or adjusted under 35 U.S.C. 154(b) by 311 days.

(21) Appl. No.: 12/135,401

(22) Filed: Jun. 9, 2008

(65) Prior Publication Data

US 2009/0304540 A1 Dec. 10, 2009

(51) Int. Cl.
*F03C 4/00* (2006.01)
*F04C 18/00* (2006.01)

(52) U.S. Cl. ..... 418/206.6; 418/104; 418/206.1; 418/206.7

(58) Field of Classification Search ..... 418/104, 418/206.1–206.9; 29/888.023
See application file for complete search history.

(56) References Cited

U.S. PATENT DOCUMENTS 3,191,545 A * 6/1965 Funk ..... 418/206.6
3,291,059 A * 12/1966 Werra ..... 418/206.9
4,293,290 A * 10/1981 Swanson ..... 418/206.7
4,453,901 A * 6/1984 Zimmerly ..... 418/206.1
5,062,777 A * 11/1991 Carlsson ..... 418/104
6,283,740 B1 * 9/2001 Brown ..... 418/206.6

FOREIGN PATENT DOCUMENTS

EP 444941 A1 * 9/1991

* cited by examiner

*Primary Examiner* — Theresa Trieu
(74) *Attorney, Agent, or Firm* — Miller, Matthias & Hull LLP

(57) ABSTRACT

Rotary lobe pump and circumferential piston pump designs are disclosed where the drive and driven shafts are detachably connected to their respective rotors. The rotors are disposed in a pump or rotor casing, which is sandwiched between a head cover and a gearbox. The drive and driven shafts pass through mechanical seal assemblies, which are sandwiched between the first and second rotors and the gear box respectively. The seal assemblies can be serviced or replaced by simply removing the head cover and removing the rotors from the drive and driven shafts. The pump casing does not need to be removed to replace or service the seal assemblies. Further, the capacities of the disclosed rotary lobe and circumferential piston pumps can be modified without changing the gearboxes or shaft length. To modify a pump capacity, all that needs to be changed are the rotors, the pump or rotor casing and, in some designs, the head cover or cover plate. In some designs, the cover plate is universal to the gearbox so that only the rotors and pump casing need to be changed to modify the pump capacity.

13 Claims, 7 Drawing Sheets

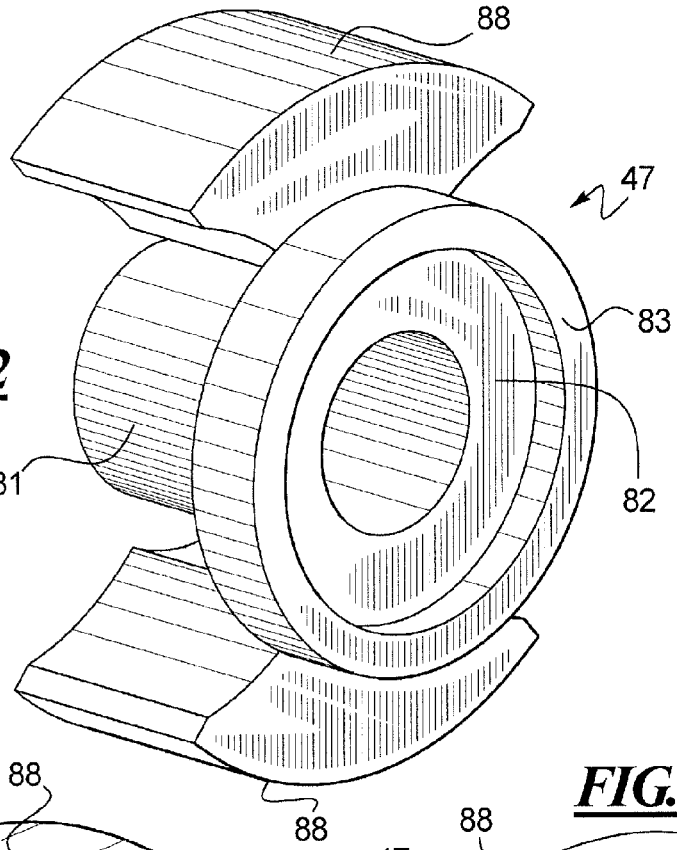
FIG. 12
FIG. 11
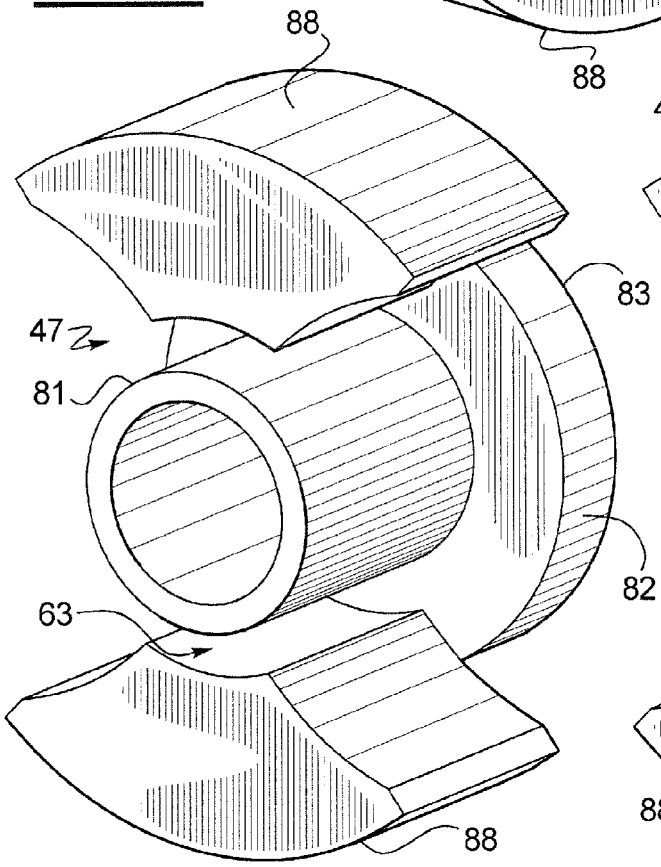
FIG. 13
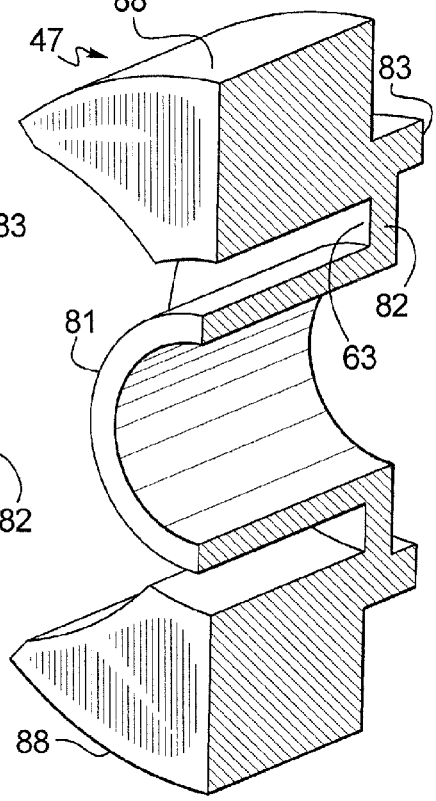

PD PUMPS WITH A COMMON GEARBOX MODULE AND VARYING CAPACITIES AND EASY ACCESS TO MECHANICAL SEALS

BACKGROUND

1. Technical Field

Improved positive displacement pumps are disclosed. More specifically, circumferential piston pumps and rotary lobe pumps are disclosed wherein a single gearbox module can be used with numerous heads of varying capacities and configurations. As a result, manufacturing costs are reduced because a single gearbox module with a drive shaft/driven shaft set can be used with numerous heads of varying capacities. Thus, the capacity can be varied without changing the gearbox or shaft length. Further, the mechanical shaft seals can be accessed for servicing or replacement without removal of the pump or rotor casing. Specifically, the mechanical shaft seals can be accessed merely by removal of the head cover plate and rotors, which are easily detachable from the drive and driven shafts.

2. Description of the Related Art

A positive displacement pump emits a given volume of fluid for each revolution of the motor or drive shaft. Bellows, double-diaphragm, flexible impeller, gear, oscillating, piston, progressing cavity, rotary vane, peristaltic, rotary lobe and circumferential piston pumps are all examples of positive displacement pumps. This disclosure is directed primarily towards new rotary lobe pump (RLP) and circumferential piston pump (CPP) designs. Both RLPs and CPPs employ a drive shaft and a driven shaft with rotors mounted on both shafts. The rotors are disposed in the pump casing sandwiched between a head cover and a gearbox. The head cover and rotor or pump casing are often collectively referred to as the "head" and the terms rotor casing and pump casing are used interchangeably.

Rotary lobe pumps use timing gears to eliminate contact between the rotors, which enables their use on non-lubricating fluids. Various rotor forms are available, including bi-wing (or bi-lobe) and multi-lobe options. These pumps offer both sanitary and hygienic designs which meet various standards imposed for food, dairy, beverage, bio-tech, and pharmaceutical applications. RLPs are also used in chemical and specialty chemical industries. Industrial RLP designs may include bearings on both sides of the rotors for higher pressure capabilities.

While circumferential piston pumps are timed like rotary lobe pumps, the rotor wings (i.e., the "pistons" in circumferential piston) rotate in chambers machined into the pump casing. This provides a large sealing surface which minimizes slip and provides increased efficiencies for low viscosity fluids. However, with the chambers machined into the pump casing, CPPs are significantly more difficult to clean and therefore can be less preferred for sanitary or hygienic applications.

In general, CPPs are preferred for lower viscosity liquids (less than 500 centipoise) and applications where cleaning and sanitization is not frequently needed; RLPs are preferred for higher viscosity liquids (greater than 500 centipoise) and sanitary or hygienic applications because of the ease in which an RLP can be cleaned.

One problem associated with both RLP and CPP designs is the inability to vary capacity without changing the overall pump design. Specifically, current RLP and the CPP designs require different gearboxes and shaft lengths for different capacities.

Another problem associated with RLP and CPP designs is the servicing of the mechanical shaft seals. Specifically, the mechanical shaft seals are traditionally mounted between the casing and a gearbox thereby requiring the head cover, rotors and casing to be removed in order to service the seals. This procedure is time-consuming and therefore costly. Accordingly, there is a need for improved CPP and RLP designs wherein access to the mechanical shaft seals is facilitated.

SUMMARY OF THE DISCLOSURE

In accordance with the aforenoted needs, an improved positive displacement pump is disclosed which comprises a drive shaft that passes through a gearbox and that is detachably connected to a first rotor. The rotor may be of a circumferential piston type (i.e. wing-type or wing-style) or of the rotary lobe type. The drive shaft is rotatively coupled to a driven shaft and the driven shaft is detachably connected to a second rotor. The first and second rotors are disposed in a pump casing, which is sandwiched between a head cover and the gearbox. The drive and driven shafts pass through first and second mechanical seals respectively, which are sandwiched between the first and second rotors and the gear box respectively.

An advantage of the disclosed designs lies in the ease in which the seals can be serviced or replaced. Specifically, removal of the head cover and the first and second rotors from the drive and driven shafts respectively provides access to the first and second mechanical seals, without removing the casing.

Further, in a refinement, the first and second rotors each comprise a central hub for accommodating the drive and driven shafts respectively. The central hubs of the first and second rotors are connected to annular sections. The annular sections connect their respective central hub to at least one radially outwardly directed wing or lobe.

In another refinement, the casing comprises a rear wall with first and second openings for accommodating the drive and driven shafts respectively. In this refinement, the annular sections of the first and second rotors are each connected to a rearwardly extending outer hub. The rearwardly extending outer hubs are, in turn, accommodated in first and second recesses disposed in the rear wall of the casing.

In another refinement, the first and second recesses in the rear wall of the casing that accommodate the rearwardly extending outer hubs are disposed along outer peripheries of the first and second openings in the rear wall of the casing through which the drive and driven shafts pass.

In another refinement, the first and second mechanical seal assemblies are at least partially disposed within the rearwardly extending outer hubs of the first and second rotors respectively.

In another refinement, the rearwardly extending outer hubs of the first and second rotors are journalled into the rear wall of the casing.

In yet another refinement, the first and second rotors each comprise a central hub for accommodating the drive and driven shafts respectively. Each central hub includes a distal end directed towards the head cover and a proximal end directed towards the gear box. The proximal ends of the central hubs of the first and second rotors are each connected to an annular section that connects its respective proximal end to at least one radially outwardly directed wing as well as the rear annular hub.

In yet another refinement, the first and second rotors each include an annular slot between their respective central hubs and their respective wing or lobe. The head cover, in such an embodiment, includes first and second cup-shaped structures with first and second cylindrical walls. In this CPP design, the annular slots of the first and second rotors receive the first and second cylindrical walls of the head cover respectively.

In a refinement, the pump is a rotary lobe pump (RLP) or a circumferential piston pump (CPP).

A method for changing a capacity of a positive displacement pump is also disclosed. The method comprises: removing the head cover; removing the first and second rotors; removing the pump casing; replacing the pump casing with a second casing sized to accommodate third and fourth rotors with the third and fourth rotors having different sizes than the first and second rotors; mounting the third and fourth rotors on the drive and driven shafts; and mounting a second head cover on the second casing.

In a refinement, a second head cover is not necessary as the original head cover will fit onto the second pump casing and new rotors.

In another refinement the method further comprises removing the first and second seals after removing the first and second rotors and before removing the pump casing.

A method for removing mechanical seal assemblies from CPPs and RLPs is also disclosed. The method comprises: removing the head cover; removing the first and second rotors from the drive and driven shafts;

for one of the mechanical seal assemblies, inserting a tool into an opening between a rear wall of the pump casing and a gearbox to obtain access to a disk or ring member disposed between the mechanical seal assembly and the gearbox; applying a biasing force on the disk or ring member to move the mechanical seal assembly in a proximal direction or towards the pump cavity from which its respective rotor has been removed; removing the mechanical seal assembly by hand; replacing the mechanical seal assembly; and repeating the process for the other mechanical seal assembly.

In another refinement, the above method is carried out without removing the pump casing.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein:

FIG. 11 is a front perspective view of a CPP-style rotor for use in the pumps illustrated in FIGS. 1-5;

FIG. 12 is a rear perspective view of the rotor illustrated in FIG. 11; and FIG. 13 is a front sectional perspective view of the rotor illustrated in FIGS. 11-12.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
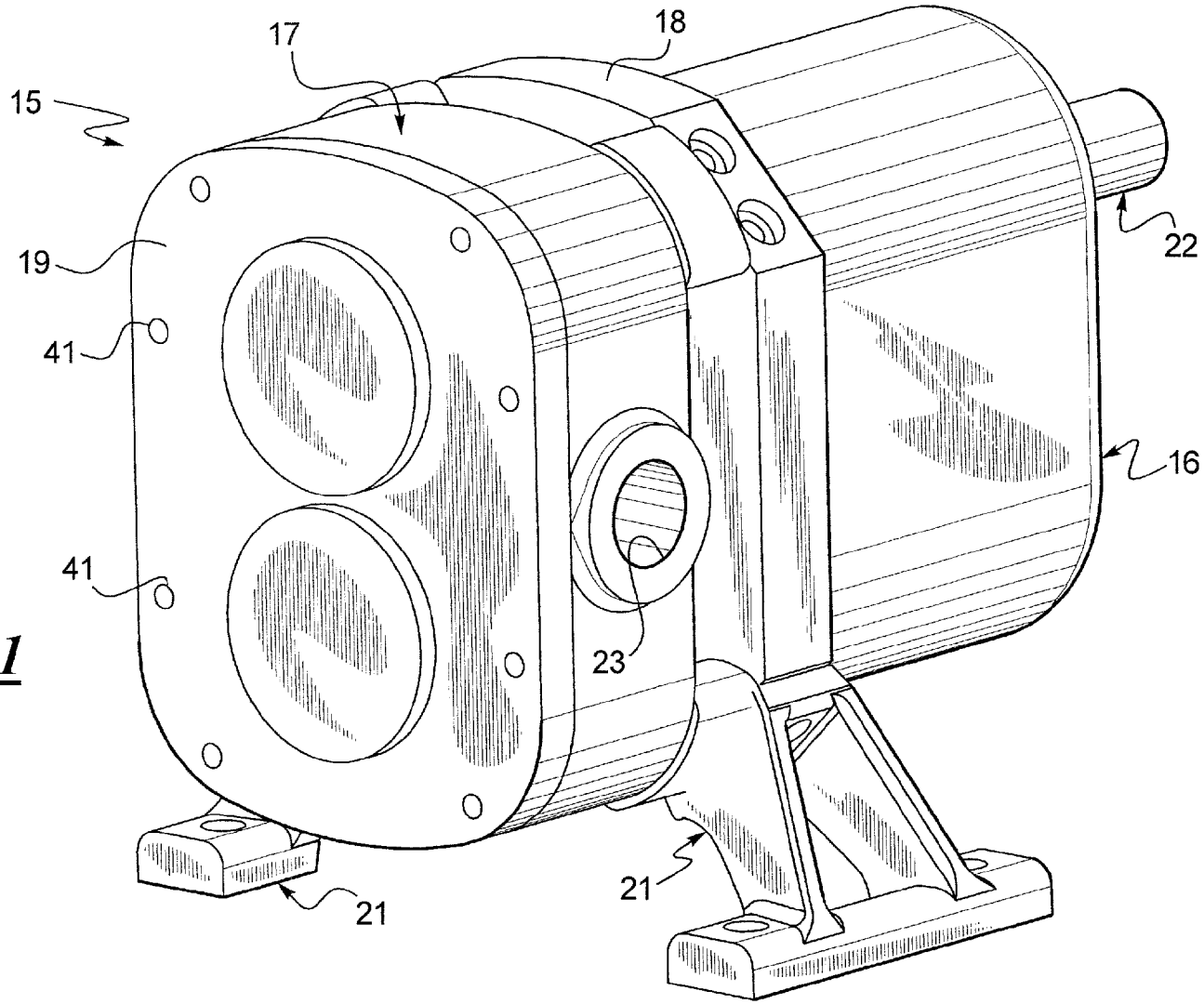
FIG. 1 is a perspective view of a circumferential piston pump made in accordance with this disclosure.

FIG. 1 illustrates, generally, a CPP 15 which includes a gearbox 16 connected to a rotor or pump casing 17 which is sandwiched between the flange 18 of the gearbox 16 and a head cover or cover plate 19. Supporting legs or brackets are shown at 21, while the drive shaft is partially visible at 22, and an inlet or outlet is shown at 23 and FIG. 1.

Figure 2:
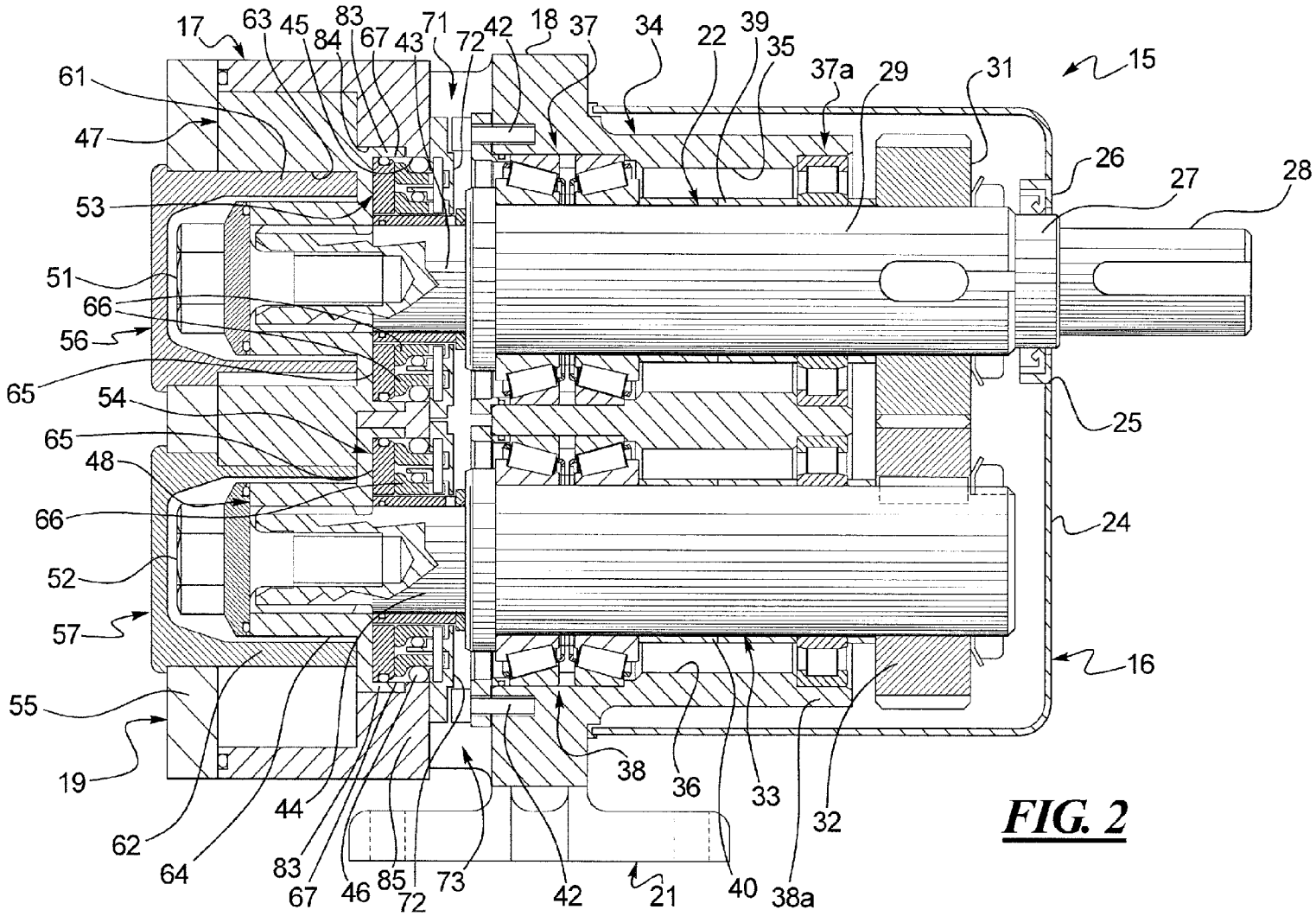
FIG. 2 is a side sectional view of the CPP shown in FIG. 1.

The CPP 15 is illustrated in greater detail in FIG. 2. The gearbox 16 includes a housing or shell 24 with an opening 25 that accommodates the driveshaft 22. An enclosing seal 26 is disposed between the mid-section 27 of the driveshaft 22 and the opening 25 in the gearbox housing 24. The proximal section 28 of the driveshaft 22 is connected to a motor (not shown). Another mid-section 29 of the driveshaft 22 passes through a drive gear 31. The drive gear 31 is enmeshed with a driven gear 32. The driven gear 32 is mounted onto the driven shaft 33. The drive and driven shafts 22, 33 pass through the gearbox casing 34 which includes first and second elongated openings 35, 36 for accommodating the drive and driven shafts 22, 33 and the supporting bearings 37, 38, 37*a*, 38*a* and bushings 39, 40 respectively. The drive and driven shafts 22, 33 pass through the flange 18 of the gearbox casing 34 which is connected to the rotor or pump casing 17 by a plurality of bolts or fasteners shown at 41 in FIG. 1 that pass through the head cover 19 and rotor casing body 17 before reaching the flange 18 of the gearbox casing 34. The bearings 37, 38 are connected to the flange 18 of the gearbox casing 34 by the bolts or fasteners shown at 42 in FIG. 2.

Distal sections 43, 44 of the drive and driven shafts 22, 33 respectively pass through first and second openings 45, 46 of the pump casing 17 respectively. The distal sections 43, 44 of the drive and driven shafts 22, 33 are connected to a first and second rotors 47, 48 respectively by the bolts or threaded fasteners 51, 52, which, as explained below, make it fast and easy to remove the rotors 47, 48 to provide quick access to the seal assemblies 53, 54.

In the embodiment illustrated in FIG. 2, the head cover 19 further comprises a head plate 55 and a pair of cup-shaped members 56, 57 which include inwardly directed cylindrical walls 61, 62 that are received in the annular recesses 63, 64 of the rotors 47, 48, which can be more clearly seen in the exemplary CPP rotor 47 illustrated in FIGS. 11-13.

One frequent maintenance task associated with the pump 15 illustrated in FIGS. 1-2 is repair or replacement of the seal assemblies 53, 54. In the embodiment 15 illustrated in FIG. 2, to access the seal assemblies 53, 54, a technician only needs to remove the head cover assembly 19 (the plate 55 and cup-members 56, 57 are connected and therefore removed together) and the rotors 47, 48. The pump casing 17 does not need to be disconnected from the gearbox 16. Accordingly, the time-consuming task of removing the pump or rotor casing 17 is avoided when servicing the seal assemblies 53, 54 which, in turn, makes repair or replacement of the seal assemblies 53, 54 much faster and less costly in terms of downtime than currently available CPPs (or RLPs as illustrated in connection with FIGS. 6-9).

In the embodiment illustrated in FIG. 2, the seal assemblies 53, 54 each include a front polymeric seal member 65, one or more inner seal members 66 and a rigid seal housing 67 that substantially contains the inner seal members 66. With the head cover 19 and rotors 47, 48 removed, a thin tool (not shown), such as a flat head screwdriver, can be inserted downward through the upper opening 71 to access the annular ring or member 72. A biasing force on the annular disc 72 towards the front of the pump 15 or towards the left in FIG. 2 will push the rigid seal housing 67 disposed around the driveshaft 22 towards the left in FIG. 2, thereby enabling hand access to the front seal 65 and eventually the rigid steel housing 67 so that the driveshaft seal assembly 53 can be repaired or replaced. Similarly, the same tool (not shown) can be inserted upward through the bottom opening 73 to access the annular disc or ring 72 that surrounds the driven shaft 33. A biasing force to the left in FIG. 2 will enable access to the front seal 65 through the rotor casing 17 (as the rotor 48 has been removed) and the rigid seal housing 66 so that the driven shaft seal assembly 54 can be replaced or serviced.

A technician may also access the seal assemblies 53, 54 from the front side of the pump 15, as space is provided when the rotors 47, 47 and their annular hubs 83 are removed as shown in FIG. 2.

Figure 3:
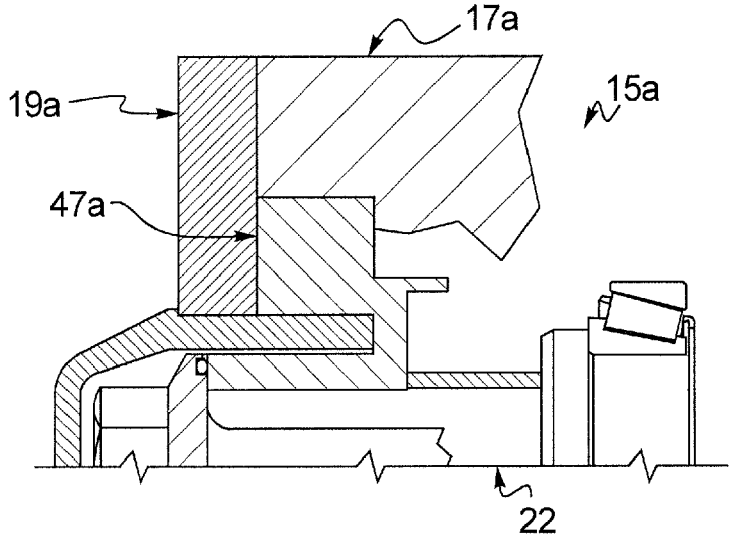
FIGS. 3-5 are partial and enlarged sectional views of three different size head covers/rotors/casings on the same drive or driven shaft thereby illustrating the ease in which the capacity of the CPPs illustrated in FIGS. 1-5 can be changed without changing the drive and driven shafts and without changing the gearboxes.
Figure 4:
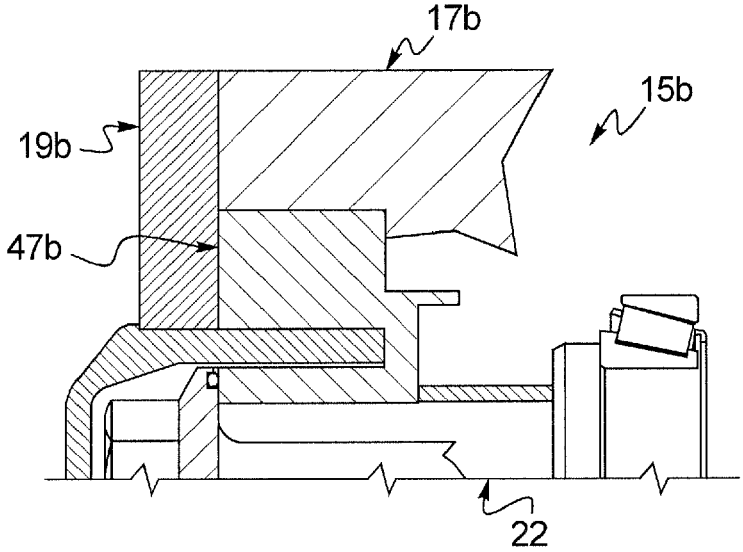
Figure 5:
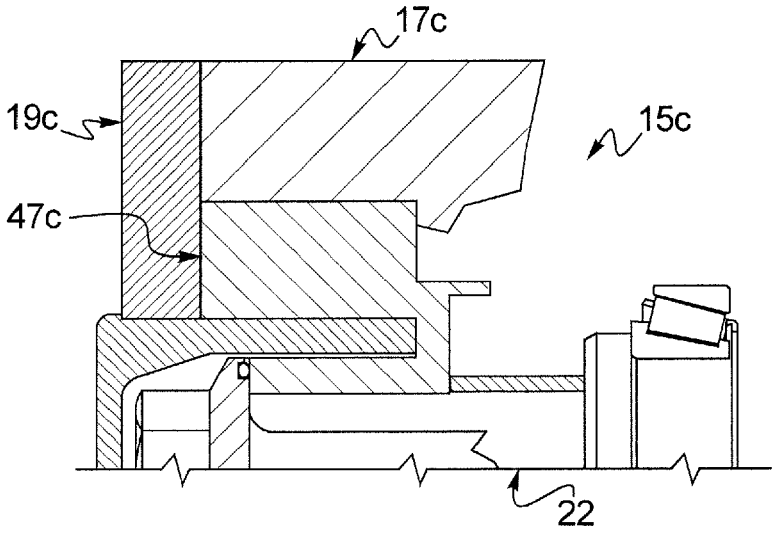

Turning to FIGS. 3-5, the versatility of the CPP 15 is illustrated. Specifically, three different rotors 47*a*, 47*b*, 47*c* of different sizes are illustrated. However, the size and length of the driveshaft 22 remains unchanged (and the driven shaft 33 and gearbox remain unchanged in FIGS. 2-5). To accommodate the different sized rotors 47*a*, 47*b*, 47*c*, only the head covers 19*a*, 19*b*, 19*c* and rotor casings 17*a*, 17*b*, 17*c* need to be modified. The driveshaft 22 (and driven shaft 33) and therefore the gearbox 16 (not shown in FIGS. 3-5; see FIG. 2) do not require modification or changing. Therefore, one set of drive and driven shafts 22, 33 and one gearbox 16 can accommodate multiple pump configurations 15*a*, 15*b*, 15*c* of varying capacities. Current CPP pump designs do not permit the capacity of the pump to be substantially modified without changing the gearbox and shaft lengths and are therefore less versatile than the disclosed CPP 15. While only three different rotor sizes are shown in FIGS. 2-6, using the disclosed CPP pump design 15, many different pump capacities can be obtained using a single gearbox 16/driveshaft 22/driven shaft 33 combination. The only components that need modification or changing to modify the pump 15 capacity are: the rotors 47, 48; the pump casing 17; and the head cover 19. As shown below in connection with FIGS. 6-9, a universal head cover 19 is also possible, which would mean only the rotors 47, 48 and pump casing 17 would need to be changed to alter the capacity of the pump 15.

Figure 6:
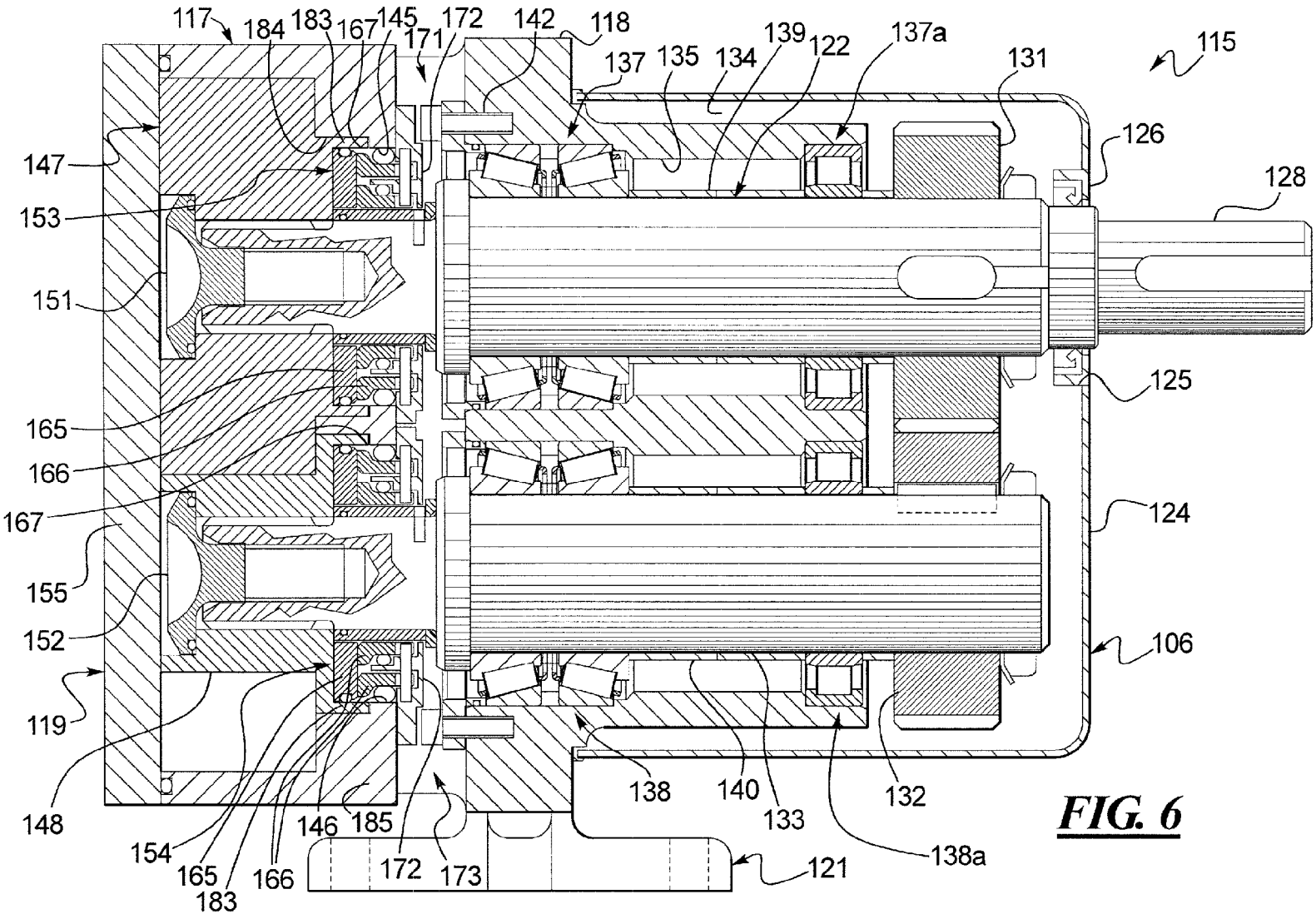
FIG. 6 is a sectional view of a rotary lobe pump made in accordance with this disclosure.

Turning to FIG. 6, a RLP 115 is disclosed. The same or similar components in the RLP 115 described above in connection with the CPP 15 will be referred to using like reference numerals with the prefix "1", or beginning with the reference numeral 115 instead of 15, etc. Hence, the functional descriptions of each part or component of the RLP 115 that finds a like part or component in CPP 15 will not be repeated here. However, it will be noted that RLP 115 includes upper and lower openings 171, 173 which enables a thin tool to access the annular discs 172 to push the seal assemblies 153, 154 forward or to the left in FIG. 6, after the head cover 119 and rotors 147, 148 have been removed. Hence, to service the seal assemblies 153, 154, the rotor casing 117 does not need to be removed. Also, the seal assemblies 153, 154 may be accessed directly from the front of the pump 115, using the space vacated by the annular hubs 183 when the rotors 147, 148 are removed.

Figure 7:
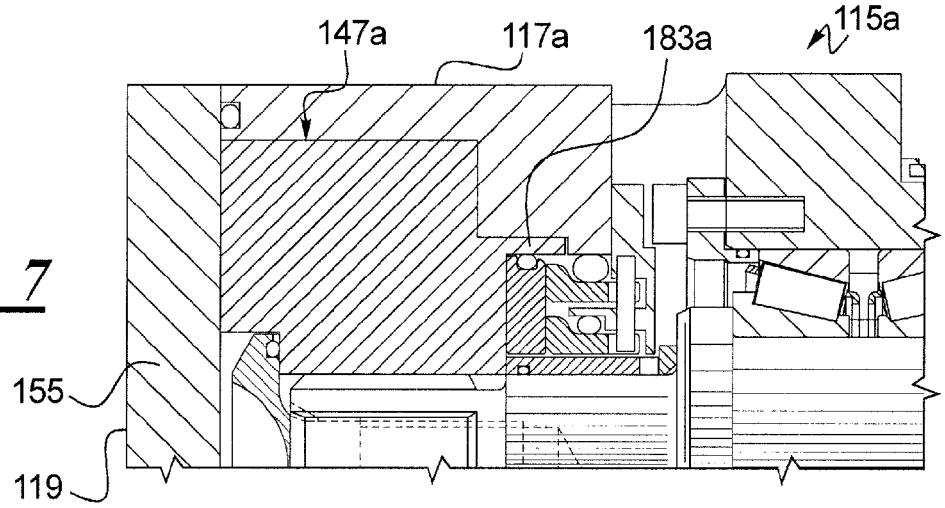
FIGS. 7-9 are partial and enlarged sectional views of three different size rotors/casings on the same drive or driven shaft thereby illustrating the ease in which the capacity of the RLPs illustrated in FIGS. 6-9 can be changed without changing the drive and driven shafts and therefore without changing the gearboxes.
Figure 8:
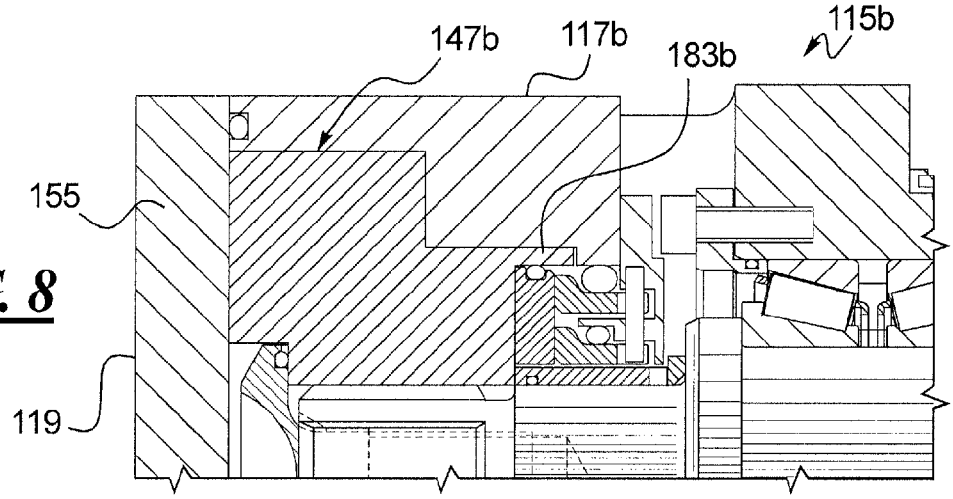
Figure 9:
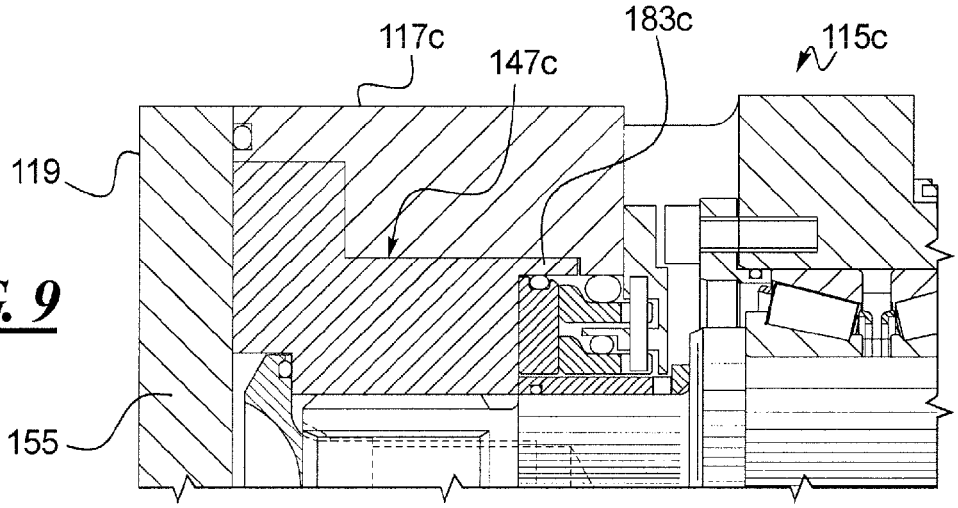

The capacity versatility of the RLP 115 is illustrated in FIGS. 7-9. Similar to the CPP 15, to change the capacity of the RLP 115, only the rotors 147*a*, 147*b*, 147*c* and rotor or pump casings 117*a*, 117*b*, 117*c* need to be changed. Because the head cover 119 comprises a flat plate 155, it is possible that the RLP 115 capacity can be modified without changing the head cover 119 and the head cover 119 is "universal" for a given gearbox 116. Therefore, changing the capacity of the RLP 115 may be even simpler than changing the capacity of the CPP 15 because only the rotors 147, 148 and casing 117 need to be changed.

Figure 10:
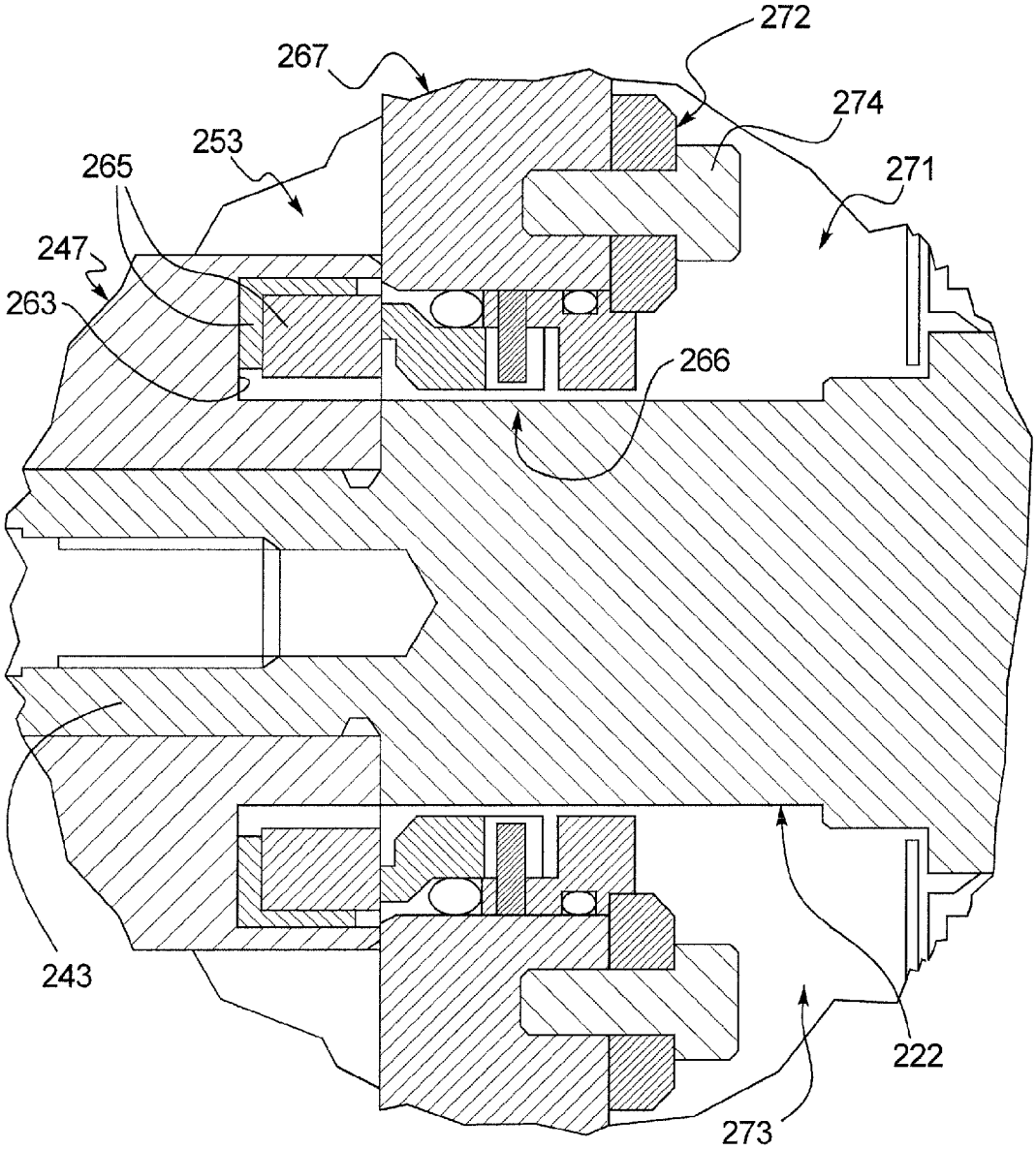
FIG. 10 is a partial sectional view of an alternative seal assembly for use in the disclosed pump designs.

FIG. 10 illustrates an alternative seal assembly to 53. The rotor 247 includes a rear annular recess 263 that accommodates front seal elements 265. The seal assembly 253 also includes rear seal elements 266 that are held in place by a seal housing 267. Upper and lower slots openings are shown at 271, 273 that enable a tool to gain access to the disk 272 or fastener 274 to bias the seal assembly 253 to the left in FIG. 10 once the rotor to 47 has been removed from the distal end to 43 of the driveshaft to 22. Thus, access to the seal assembly 253 is essentially the same as that for the assemblies 53, 153 of FIGS. 2 and 6.

FIGS. 11-13 illustrate a typical CPP rotor 47. The rotor 47 includes a central hub 81 that accommodates the drive or driven shaft 22, 33. The central hub is connected to a rear annular member 82 that connects a central hub 81 to a rear hub 83 and one or more rotor wings for lobes 88. As seen in FIGS. 2 and 6, the rear hubs 83, 183 are received in recesses disposed in the pump casings 17, 117. In the embodiments illustrated in FIGS. 2 and 6, the rear annular hubs 83, 183 are received in recesses 84 (FIG. 2), 184 (FIG. 6) that are coaxial with or form a radial extension of the first and second openings 45, 46 (FIG. 2) and 145, 146 (FIG. 6) through which the drive and driven shafts 22, 33 and 122, 133 respectively pass. In other embodiments, the rear annular hubs 83, 183 may be accommodated within a groove or slot disposed in the rear wall 85 (FIG. 2), 185 (FIG. 6) of the pump casing 17, 117. The design of a RLP rotor 147 is similar to the CPP rotor 47 illustrated in FIGS. 10-12, without an annular slot 63 as the head cover 119 of the RLP 115 does not include the cup-shaped members 56, 57.

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A positive displacement pump comprising:

a drive shaft passing through a gearbox and being detachably connected to a first rotor, the drive shaft being rotatively coupled to a driven shaft, the driven shaft being detachably connected to a second rotor, the first and second rotors being disposed in a pump casing, the pump casing being disposed between a head cover and the gearbox, the drive and driven shafts passing through first and second mechanical seals respectively that are sandwiched between the first and second rotors and the gear box respectively, the first and second rotors each comprise a central hub for accommodating the drive and driven shafts respectively, each central hub comprising a distal end directed towards the head cover and a proximal end directed towards the gear box, the proximal ends of the central hubs of the first and second rotors each being connected to an annular section that connects its respective proximal end to at least one radially outwardly directed wing, the first and second rotors each comprise an annular slot between their respective central hubs and its respective wing, the head cover comprising first and second cup-shaped structures with first and second cylindrical walls, and the annular slots of the first and second rotors receiving the first and second cylindrical walls of the head cover respectively, wherein removal of the head cover and the first and second rotors from the drive and driven shafts respectively provides access to the first and second mechanical seals.

2. The pump of claim 1 wherein said access to the first and second mechanical seals includes an ability to remove the first and second seals without removing the casing.

3. The pump of claim 2 wherein the casing comprises a rear wall with first and second openings for accommodating the drive and driven shafts respectively, and the annular sections of the first and second rotors are each connected to a rearwardly extending the outer hub that is accommodated in first and second recesses disposed in the rear wall of the casing.

4. The pump of claim 3 wherein the first and second recesses are disposed along outer peripheries of the first and second openings respectively in the rear wall of the casing.

5. The pump of claim 3 wherein the first and second mechanical seals are at least partially disposed within the rearwardly extending outer hubs of the first and second rotors respectively.

6. The pump of claim 1 wherein the first and second rotors each comprise a central hub for accommodating the drive and driven shafts respectively, the central hubs of the first and second rotors being connected to annular sections that are each disposed between its respective central hub and at least one radially outwardly directed wing of its respective rotor.

7. The pump of claim 6 wherein the rearwardly extending outer hubs of the first and second rotors are journalled into the rear wall of the casing.

8. The pump of claim 1 wherein the pump is one of a rotary lobe pump or a circumferential piston pump.

9. A positive displacement pump comprising:

a drive shaft passing through a gearbox, the drive shaft being detachably connected to a first rotor, the drive shaft being rotatively coupled to a driven shaft, the driven shaft being detachably connected to a second rotor, the first and second rotors being disposed in a pump casing, the pump casing being disposed between a head cover and the gearbox, the first and second rotors being accommodated in first and second cavities respectively in the pump casing, the first and second rotors each comprise a central hub for accommodating the drive and driven shafts respectively, each central hub comprising a distal end directed towards the head cover and a proximal end directed towards the gear box, the proximal ends of the central hubs of the first and second rotors each being connected to an annular section that connects its respective proximal end to at least one radially outwardly directed wing, the first and second rotors each comprise an annular slot between their respective central hubs and its respective wing, the head cover comprising first and second cup-shaped structures with first and second cylindrical walls, and the annular slots of the first and second rotors receiving the first and second cylindrical walls of the head cover respectively, wherein a capacity of the pump is varied by changing the first and second rotors and pump casing without changing the gearbox.

10. The pump of claim 9 wherein the head cover must also be changed to change the capacity of the pump.

11. The pump of claim 9 wherein the drive and driven shafts pass through first and second mechanical seals respectively that are sandwiched between the first and second rotors and the gear box respectively, and wherein removal of the head cover and the first and second rotors from the drive and driven shafts respectively provides access to the first and second mechanical seals.

12. The pump of claim 9 wherein the first and second rotors each comprise a central hub for accommodating the drive and driven shafts respectively, the central hubs of the first and second rotors being connected to annular sections that are each disposed between its respective central hub and at least one radially outwardly directed wing of its respective rotor.

13. The pump of claim 12 wherein the casing comprises a rear wall with first and second openings for accommodating the drive and driven shafts respectively, and the annular sections of the first and second rotors are each connected to a rearwardly extending the outer hub that is accommodated in first and second recesses disposed in the rear wall of the casing.

* * * * *